US007385556B2

(12) United States Patent
Chung et al.

(10) Patent No.: US 7,385,556 B2
(45) Date of Patent: Jun. 10, 2008

(54) PLANAR ANTENNA

(75) Inventors: Cho-Ju Chung, Taipei Hsien (TW); Teng-Huei Chu, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/615,019

(22) Filed: Dec. 22, 2006

(65) Prior Publication Data

US 2008/0106473 A1 May 8, 2008

(51) Int. Cl.
*H01Q 1/38* (2006.01)

(52) U.S. Cl. ..... 343/700 MS; 343/895; 343/846; 343/829

(58) Field of Classification Search ..... None
See application file for complete search history.

(56) References Cited

U.S. PATENT DOCUMENTS 5,926,139 A * 7/1999 Korisch ..... 343/702
6,094,170 A * 7/2000 Peng ..... 343/700 MS
6,930,640 B2 * 8/2005 Chung et al. ..... 343/700 MS
6,933,902 B2 * 8/2005 Yeh ..... 343/762
7,106,259 B2 * 9/2006 Tseng et al. ..... 343/702
7,183,981 B1 * 2/2007 Chao ..... 343/700 MS
7,259,720 B2 * 8/2007 Ryu ..... 343/700 MS

FOREIGN PATENT DOCUMENTS

CN 1819337 A 8/2006

* cited by examiner

*Primary Examiner*—Trinh V Dinh
(74) *Attorney, Agent, or Firm*—Wei Te Chung

(57) ABSTRACT

A planar antenna (20) includes a radiating body (21), a feeding portion (22), and a first metallic ground plane (24). The radiating body includes a first radiating portion (212) extending away from the feeding portion and a second radiating portion (214) extending away from the feeding portion next to the first radiating portion. The first radiating portion includes an open end (2122) disposed at an extending end of the first radiating portion to point toward the second radiating portion, and a connecting portion (2124). The second radiating portion includes a free end (2144) disposed at an extending end of the second radiating portion to point toward the first radiating portion, and an end (2146) connected to the connecting portion. A first gap (26) is formed between the open end and the free end. The open end, the first gap and the free end are aligned with one another.

18 Claims, 11 Drawing Sheets

PLANAR ANTENNA

BACKGROUND OF THE INVENTION

1. Field of the Invention

The invention relates to antennas, and particularly to a planar antenna.

2. Description of Related Art

Wireless communication devices, such as mobile phones, wireless cards, and access points, wirelessly radiate signals via electromagnetic waves. Thus, remote wireless communication devices can receive the signals without the need for cables.

In a wireless communication device, the antenna is a key element for radiating and receiving radio frequency signals. Characteristics of the antenna, such as radiation efficiency, orientation, frequency band, and impedance matching, have a significant influence on performance of the wireless communication device. Nowadays, there are two kinds of antennas, built-in antennas and external antennas. Compared to the external antenna, the size of the built-in antenna is smaller, and the body of the built-in antenna is protected and not easily damaged. Thus, the built-in antenna is commonly employed in wireless communication devices. Common built-in antennas include low temperature co-fired ceramic (LTCC) antennas and printed antennas. The LTCC antenna has good performance at high frequencies and at high temperatures, but is expensive. A common type of printed antenna is the planar inverted-F antenna. Compared to LTCC antennas, planar inverted-F antennas are small, light, thin, and inexpensive. Accordingly, planar inverted-F antennas are mostly used in wireless communication devices.

In general, the planar inverted-F antenna is a printed circuit disposed on a substrate for radiating and receiving radio frequency signals. FIG. 1 is a schematic plan view of a conventional planar inverted-F antenna. The planar inverted-F antenna disposed on a substrate 10 includes a metallic ground plane 20, a radiating part 30, an open-short transforming part 40, and a feeding part 50. The metallic ground plane 20 is laid on the substrate 10, and includes an opening 60. The radiating part 30 includes an open end 31 and a first connecting end 33. The open end 31 terminates the radiating part 30.

The open-short transforming part 40 is connected between the radiating part 30 and the metallic ground plane 20, and includes a second connecting end 41 and a third connecting end 44. The third connecting end 44 is connected to the metallic ground plane 20. The second connecting end 41 is connected to the first connecting end 33 at a joint portion 70. The feeding part 50 is connected to the joint portion 70, for feeding signals. The feeding part 50 is connected to a matching circuit (not shown) through the opening 60.

In recent years, more attention has been paid on development of small-sized and low-profile wireless communication devices. Antennas, as key elements of wireless communication devices, have to be miniaturized accordingly. Although, the above-described planar inverted-F antenna is smaller than an external antenna, it is still too large for newer smaller wireless communication devices, and the profile of the above-described planar inverted-F antenna cannot be further reduced. Therefore, what is needed is another planar antenna with a miniaturized compact profile and better performance.

SUMMARY OF THE INVENTION

An exemplary embodiment of the present invention provides a planar antenna disposed on a substrate including a first surface and a second surface. The planar antenna includes a radiating body laid on the first surface for transmitting and receiving radio frequency (RF) signals, a feeding portion for feeding signals, and a first metallic ground plane laid on the second surface of the substrate. The radiating body includes a meandering first radiating portion extending away from the feeding portion, and a second radiating portion extending away from the feeding portion next to the first radiating portion. The first radiating portion includes an open end disposed at an extending end thereof to point toward the second radiating portion, and a connecting portion disposed at another end thereof. The second radiating portion includes a free end disposed at an extending end thereof to point toward the first radiating portion, and an end connected to the connecting portion. A first gap is formed between the open end of the first radiating portion and the free end of the second radiating portion. The open end, the first gap, and the free end are aligned with one another. The feeding portion is laid on the first surface and electrically connected to the connecting portion. The first ground plane is electrically connected to the second radiating portion through a via.

Other advantages and novel features will become more apparent from the following detailed description when taken in conjunction with the accompanying drawings, in which:

DETAILED DESCRIPTION OF THE INVENTION

Figure 1:
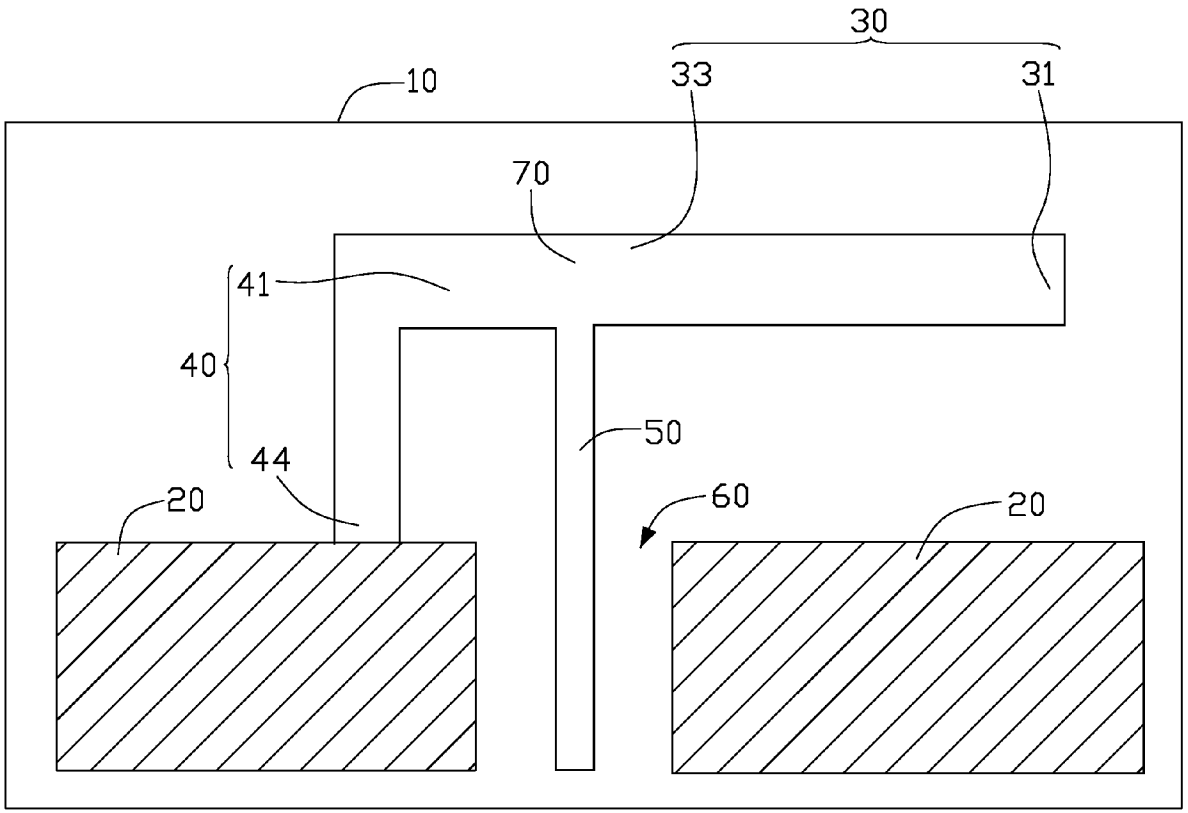
FIG. 1 (RELATED ART)
FIG. 1 is a schematic plan view of a conventional planar inverted-F antenna.
Figure 2:
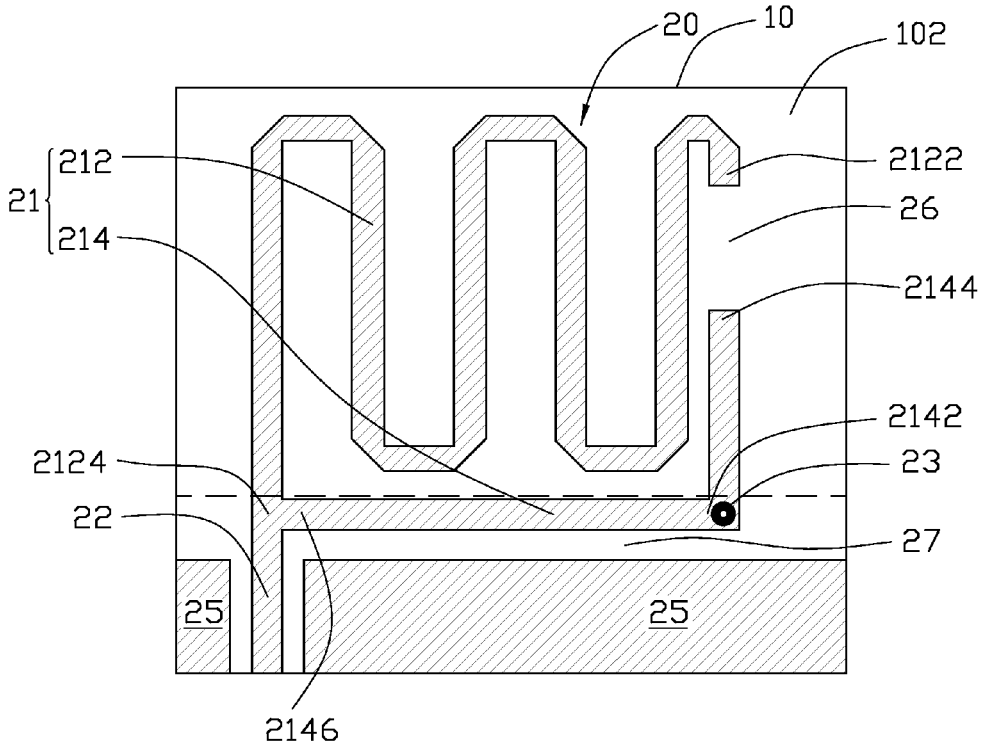
FIG. 2 is a schematic plan view of a planar antenna of an exemplary embodiment of the present invention.

FIG. 2 is a schematic plan view of a planar antenna 20 of an exemplary embodiment of the present invention. In the exemplary embodiment, the planar antenna 20 is a printed straight F antenna, and disposed on a substrate 10.

Figure 3:
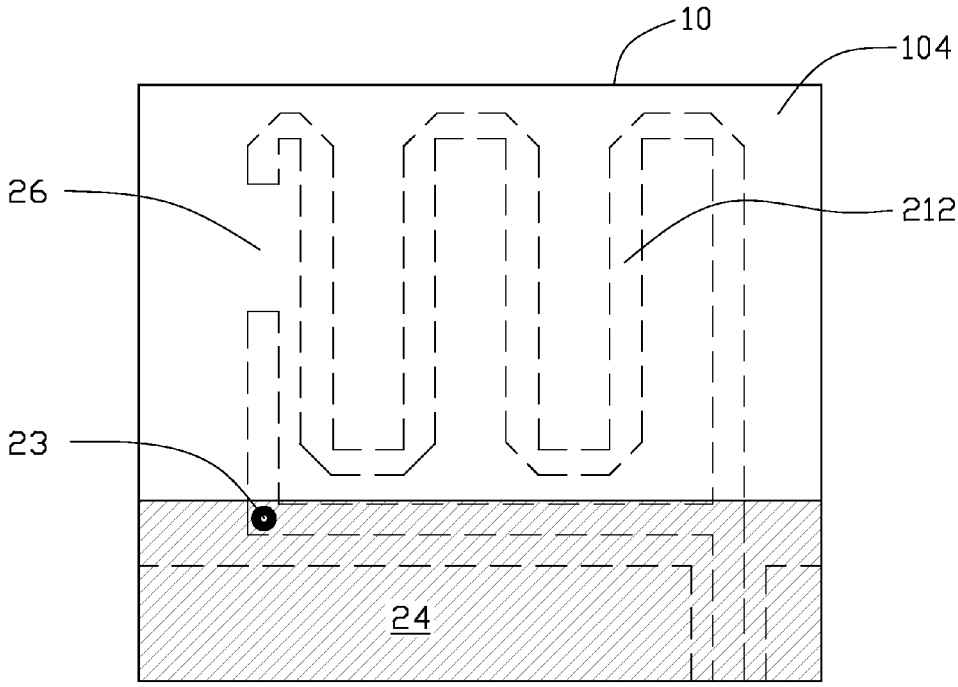
FIG. 3 is similar to FIG. 2, but viewed from another aspect.

Referring also to FIG. 3, the substrate 10 comprises a first surface 102 and a second surface 104.

The planar antenna 20 comprises a radiating body 21, a feeding portion 22, a first metallic ground plane 24 and a second metallic ground plane 25.

The radiating body 21 transmits and receives radio frequency (RF) signals, and is printed on the first surface 102. The radiating body 21 comprises a meandering first radiating portion 212 extending away to the feeding portion 22, and an L-shaped second radiating portion 214 extending away to the feeding portion 22 next to the first radiating portion 212. The first radiating portion 212 comprises an open end 2122 located at an extending end thereof to point toward the second radiating portion 214, and a connecting portion 2124 located at another end thereof. The second radiating portion 214 comprises a free end 2144 located at an extending end thereof to point toward the first radiating portion 212, and an end 2146 connected to the connecting portion 2124. A first gap 26 is formed between the free end 2144 and the open end 2122. The open end 2122, the first gap 26, and the free end 2144 are aligned with one another. The second radiating portion 214 is electrically connected to the connecting portion 2124 via the end 2146 thereof. The second radiating portion 214 comprises a short portion 2142 positioned in a right-angled corner thereof. The short portion 2142 is electrically connected to ground.

In an alternative embodiment, the number of overlapping portions of the first radiating portion 212 can be varied.

In the exemplary embodiment, the first radiating portion 212 increases bandwidth of the planar antenna 20.

In the embodiment, the route of the electromagnetic wave is indirect, allowing precise control over the length of the route followed by the electromagnetic wave. The length of the route of the electromagnetic wave from the open end 2122 to the short portion 2142 must be kept to a predetermined length, such as substantially a fourth of the working wavelength of the planar antenna 20, and so the route is configured in a switchback pattern. Therefore, relatively speaking, the planar antenna 20 of the present invention is configured in a compact manner allowing use in newer smaller wireless communication devices. That is, the planar antenna 20 has a lower profile and a smaller size.

In addition, the planar antenna 20 has a better radiation pattern due to the first radiating portion 212. And, the planar antenna 20 has a lower profile and a smaller size because of the first gap 26 formed between the free end 2144 and the open end 2122.

The feeding portion 22 is electrically connected to the connecting portion 2124, for feeding signals. The feeding portion 22 is substantially parallel to the second radiating portion 214 between the short portion 2142 and the free end 2144, and is also electrically connected to a matching circuit (not shown), for generating a matching impedance.

The first metallic ground plane 24 is printed on the second surface 104 of the substrate 10, and is electrically connected to the short portion 2142 of the second radiating portion 214 through a via 23.

The second metallic ground plane 25 is printed on the first surface 102 of the substrate 10, and adjacent to the second radiating portion 214 and the feeding portion 22. An L-shaped second gap 27 is formed between the second metallic ground plane 25, and the second radiating portion 214 and the feeding portion 22. Thus, the planar antenna 20 has a better return loss due to the second gap 27.

Figure 4:
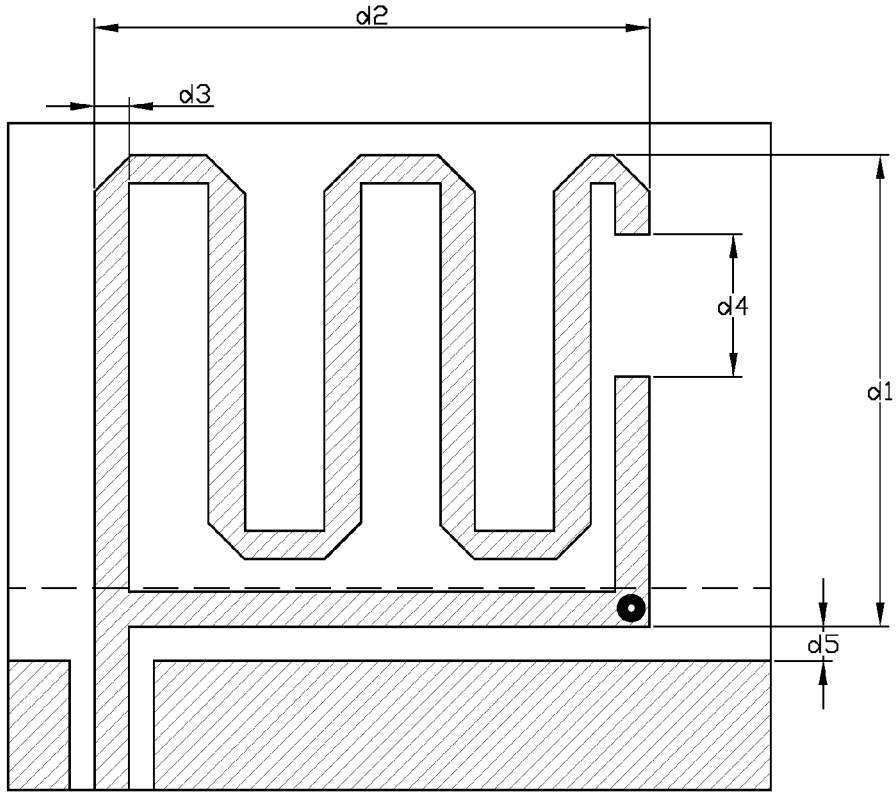
FIG. 4 is a schematic plan view illustrating dimensions of the planar antenna of FIG. 2.

FIG. 4 is a schematic plan view illustrating dimensions of the planar antenna 20 of FIG. 2. In the exemplary embodiment, a length d2 of the planar antenna 20 is generally 6.9 mm, and a width d1 of the planar antenna 20 is generally 5.9 mm. A width d3 of the radiating body 21 is generally 0.4 mm. A width d4 of the first gap 26 is generally 1.8 mm. A width d5 of the first gap 26 is generally 0.4 mm.

Figure 5:
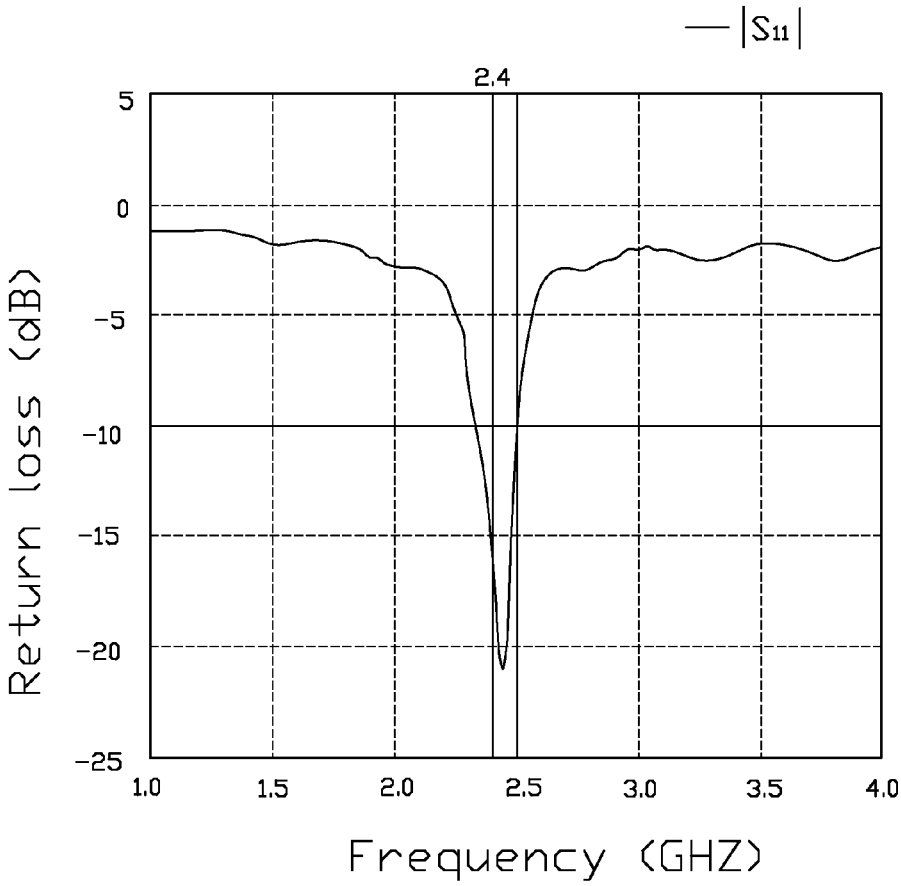
FIG. 5 is a graph of test results showing a return loss of the planar antenna of FIG. 2.
Figure 6:
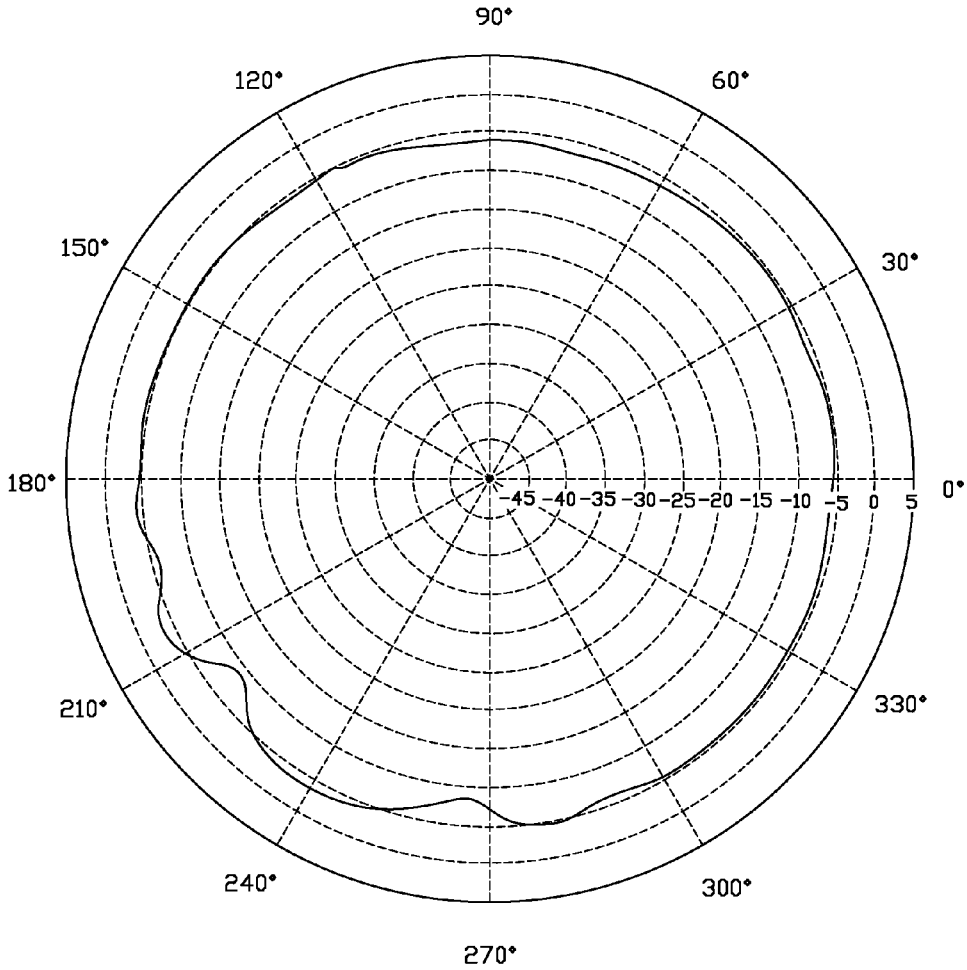
FIG. 6 is a graph of test results showing a horizontal polarization radiation pattern when the planar antenna of FIG. 2 is operated at 2.40 GHz.
Figure 7:
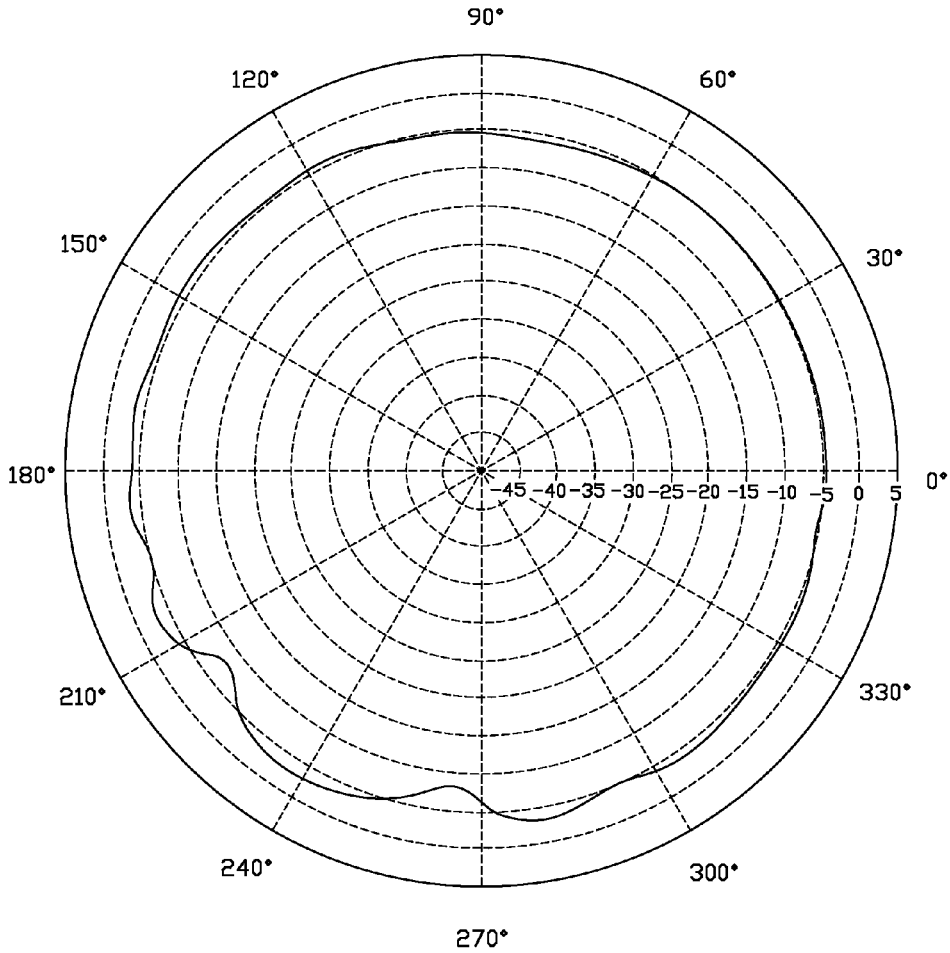
FIG. 7 is a graph of test results showing a horizontal polarization radiation pattern when the planar antenna of FIG. 2 is operated at 2.45 GHz.
Figure 8:
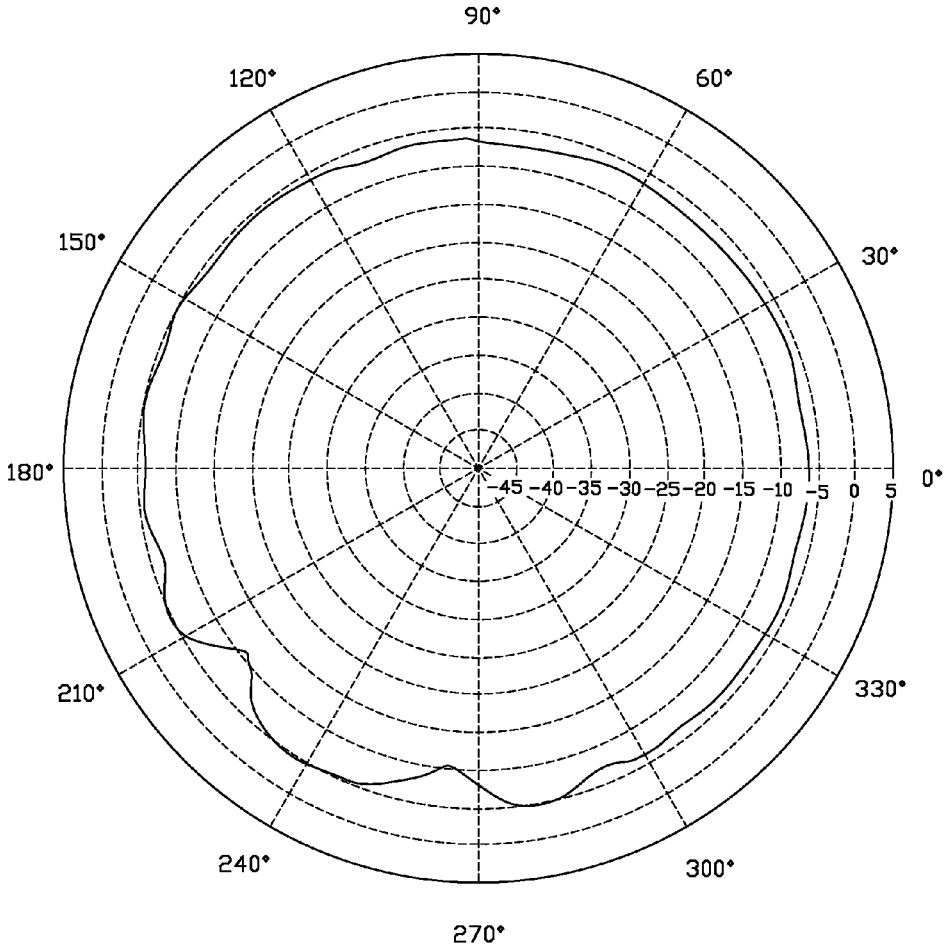
FIG. 8 is a graph of test results showing a horizontal polarization radiation pattern when the planar antenna of FIG. 2 is operated at 2.50 GHz.
Figure 9:
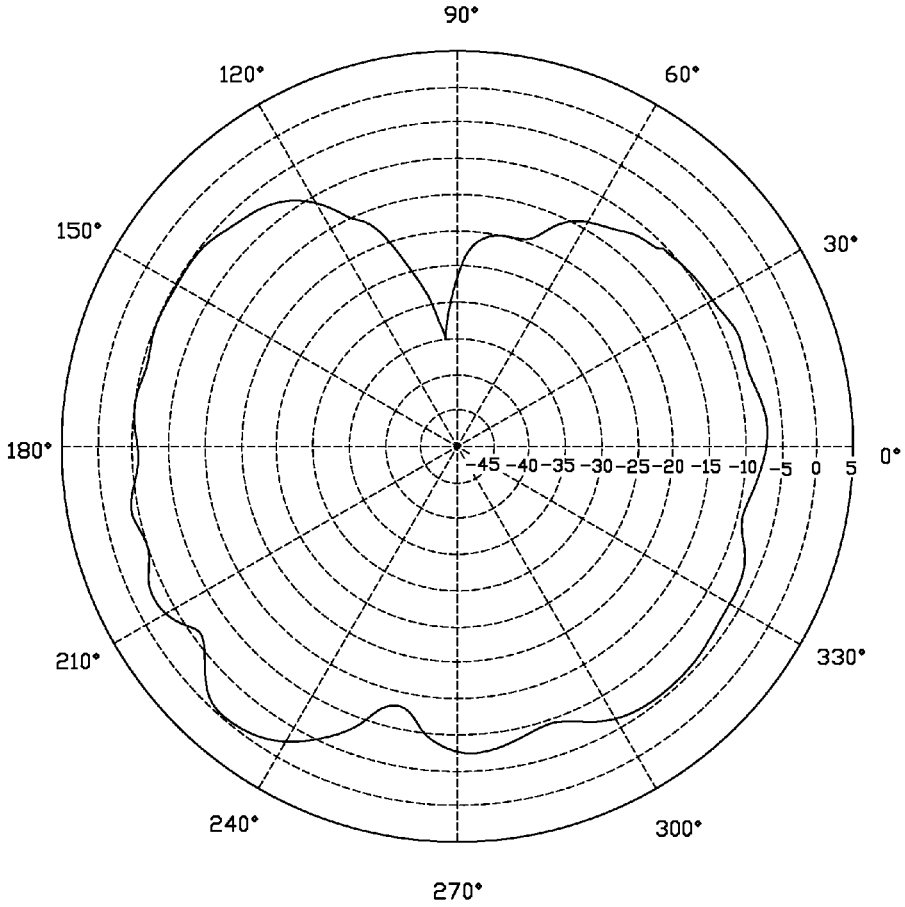
FIG. 9 is a graph of test results showing a vertical polarization radiation pattern when the planar antenna of FIG. 2 is operated at 2.40 GHz.
Figure 10:
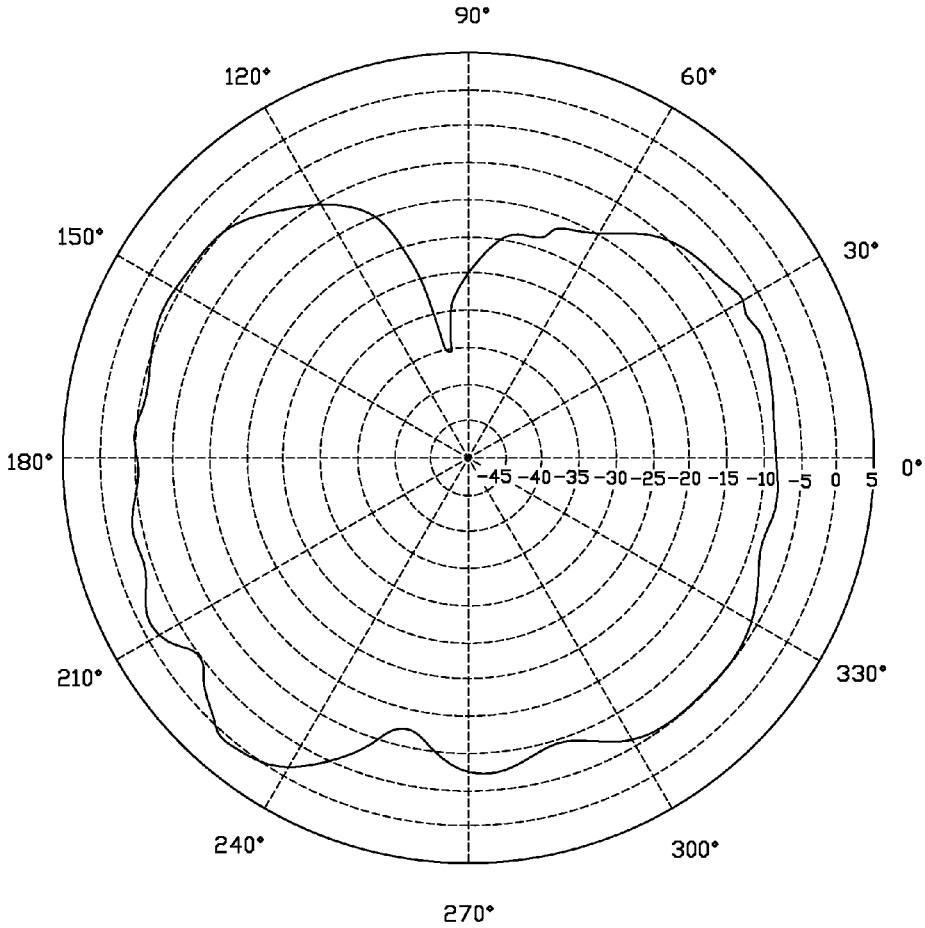
FIG. 10 is a graph of test results showing a vertical polarization radiation pattern when the planar antenna of FIG. 2 is operated at 2.45 GHz.
Figure 11:
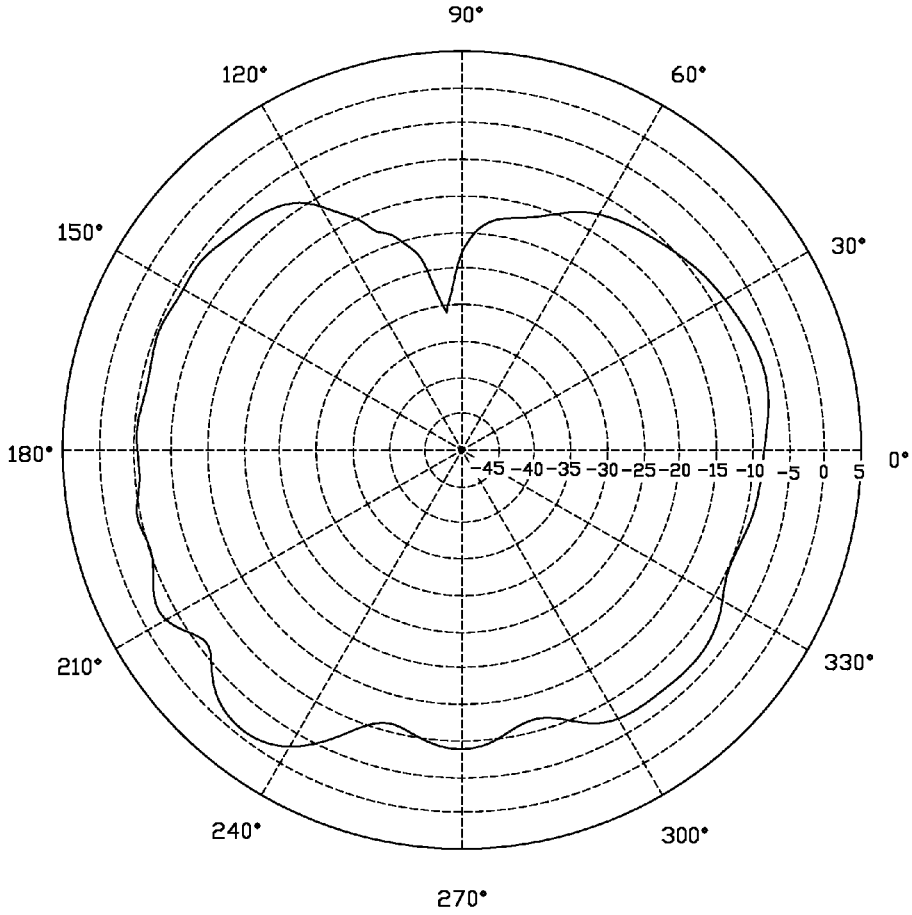
FIG. 11 is a graph of test results showing a vertical polarization radiation pattern when the planar antenna of FIG. 2 is operated at 2.50 GHz.

FIG. 5 is a graph of test results showing a return loss of the planar antenna 20 when used in a wireless communication device, with the return loss as its vertical coordinate thereof and the frequency as its horizontal coordinate. When the planar antenna operates at frequency bands of 2.4~2.5 GHz, return loss drops below −10 dB, which satisfactorily meets normal practical requirements.

FIGS. 6-11 are graphs of test results showing vertical/horizontal polarization radiation patterns when the planar antenna 20 of FIG. 2 is operated at 2.40 GHz, 2.45 GHz, and 2.50 GHz, respectively. As seen, all of the radiation patterns are substantially omni-directional.

With the above-described configuration, the planar antenna 20 has a lower profile, a smaller size, a better return loss, and an omni-directional radiation pattern.

Although various embodiments have been described above, the structure of the planar antenna should not be construed to be limited for use in respect of IEEE 802.11 only. When the size and/or shape of the planar antenna is changed or configured appropriately, the planar antenna can function according to any of various desired communication standards or ranges. Further, in general, the breadth and scope of the invention should not be limited by the above-described exemplary embodiments, but should be defined only in accordance with the following claims and their equivalents.

What is claimed is:

1. A planar antenna disposed on a substrate comprising a first surface and a second surface, the planar antenna comprising:

a feeding portion laid on the first surface for feeding signals to the antenna;

a radiating body laid on the first surface for transmitting and receiving radio frequency (RF) signals, the radiating body comprising a meandering first radiating portion extending away from the feeding portion and a second radiating portion extending away from the feeding portion next to the first radiating portion, the first radiating portion comprising an open end disposed at an extending end thereof to point toward the second radiating portion and a connecting portion disposed at another end thereof, the second radiating portion comprising a free end disposed at an extending end of the second radiating portion to point toward the first meandering radiating portion and an end connected to the connecting portion, a first gap formed between the open end of the first radiating portion and the free end of the second radiating portion, and the open end, the first gap and the free end being aligned with one another; and a first metallic ground plane, laid on the second surface of the substrate, the first ground plane electrically connected to the second radiating portion through a via.

2. The planar antenna as claimed in claim 1, wherein the second radiating portion is generally L-shaped.

3. The planar antenna as claimed in claim 2, wherein the second radiating portion comprises a short portion located in a right-angled corner thereof.

4. The planar antenna as claimed in claim 2, wherein a length of the route of the electromagnetic wave from the open end to the short portion is generally equal to a fourth of the working wavelength of the planar antenna.

5. The planar antenna as claimed in claim 1, further comprising a second metallic ground plane laid on the first surface of the substrate.

6. The planar antenna as claimed in claim 5, wherein a second gap is formed among the second radiating portion, the feeding portion, and the second ground plane.

7. An assembly comprising:

a substrate; and an antenna disposed on said substrate, and comprising a feeding portion for feeding signals to said antenna, a radiating body electrically connectable with said feeding portion to transmit and receive radio frequency (RF) signals for said antenna, said radiating body comprising a first radiating portion extending away from said feeding portion and a second radiating portion extending away from said feeding portion next to said first radiating portion, said first radiating portion comprising an open end disposed at an extending end of said first radiating portion to point toward said second radiating portion, said second radiating portion comprising a free end disposed at an extending end of said second radiating portion to point toward said first radiating portion, a gap formed between said open end of said first radiating portion and said free end of said second radiating portion, and said open end, said gap and said free end being aligned with one another.

8. The assembly as claimed in claim 7, further comprising a metallic ground plane disposed on said substrate opposite to said antenna, said ground plane electrically connectable with said second radiating portion through a via.

9. The assembly as claimed in claim 7, wherein said second radiating portion is generally L-shaped.

10. The assembly as claimed in claim 7, wherein said second radiating portion comprises a short portion located in a right-angled corner thereof.

11. The assembly as claimed in claim 7, wherein a second gap is formed among said second radiating portion, said feeding portion, and a metallic ground plane formed on the same surface of said substrate as said radiating body.

12. An assembly comprising:

a substrate comprising a first surface and a second surface opposite to said first surface; and an antenna disposed on said substrate, and comprising a feeding portion on said first surface for feeding signals to said antenna, a radiating body on said first surface electrically connectable with said feeding portion to transmit and receive radio frequency (RF) signals for said antenna, said radiating body comprising a first radiating portion extending away from said feeding portion and a second radiating portion extending away from said feeding portion next to said first radiating portion, said first radiating portion comprising an open end disposed at an extending end of said first radiating portion, said second radiating portion comprising a free end disposed at an extending end of said second radiating portion, a metallic ground plane disposed on said second surface of said substrate, said ground plane electrically connectable with said second radiating portion through a via, and said open end, said free end and said via being aligned with one another.

13. The assembly as claimed in claim 12, wherein said open end of said first radiating portion is disposed to point toward said second radiating portion, and said free end of said second radiating portion is disposed to point toward said first radiating portion.

14. The assembly as claimed in claim 13, wherein said open end of said first radiating portion and said free end of said second radiating portion are disposed to point toward each other.

15. The assembly as claimed in claim 12, further comprising a gap formed between said open end of said first radiating portion and said free end of said second radiating portion to align with said open end, said free end and said via.

16. The assembly as claimed in claim 12, wherein said second radiating portion is generally L-shaped.

17. The assembly as claimed in claim 12, wherein said second radiating portion comprises a short portion located in a right-angled corner thereof.

18. The assembly as claimed in claim 12, wherein a second gap is formed among said second radiating portion, said feeding portion, and another metallic ground plane formed on said first surface.

* * * * *